US006426586B1

(12) United States Patent
Young et al.

(10) Patent No.: US 6,426,586 B1
(45) Date of Patent: Jul. 30, 2002

(54) CONTACT GLASS COMPOSITION FOR USE IN SPARK PLUGS

(75) Inventors: Ching T. Young, San Jose, CA (US); Philip R. Woodruff, Tiffin, OH (US); Duane L. Schreiner, Fostoria, OH (US); Harold E. Dunfee, Fostoria, OH (US); Ralph Frederick, Fostoria, OH (US); Jeff A. Goldacker, Findlay, OH (US)

(73) Assignee: AlliedSignal Inc., Morristown, NJ (US)

( * ) Notice: Subject to any disclaimer, the term of this patent is extended or adjusted under 35 U.S.C. 154(b) by 0 days.

(21) Appl. No.: 09/249,522

(22) Filed: Feb. 12, 1999

(51) Int. Cl.[7] ..... H01T 13/02; H01T 13/04; H01T 13/22; H01B 1/04; H01B 1/06

(52) U.S. Cl. ..... 313/130; 313/135; 313/144; 252/504; 252/506; 252/507; 252/509

(58) Field of Search ..... 313/118, 130, 313/131 A, 135, 137, 136, 141, 144; 252/503, 504, 506, 507, 509, 510–511; 106/46

(56) References Cited

U.S. PATENT DOCUMENTS

| | | | |
|---|---|---|---|
| 3,909,459 | A | 9/1975 | Friese et al. |
| 3,931,055 | A | 1/1976 | Friese |
| 5,565,730 | A | 10/1996 | Pollner et al. |

FOREIGN PATENT DOCUMENTS

| | | |
|---|---|---|
| JP | 52-9262 | 11/1974 |
| RO | 76094 | 8/1981 |

*Primary Examiner*—Vip Patel
*Assistant Examiner*—Mack Haynes

(57) ABSTRACT

A contact glass composition for use in resistor-type spark plugs is described. The contact glass composition is a mixture of: (a) at least one metal; (b) graphite; and (c) silicon. Additionally, borosilicate glass, barium borate glass, magnesium aluminum silicate, ball clay, and aluminum may also be included in the contact glass composition.

12 Claims, 1 Drawing Sheet

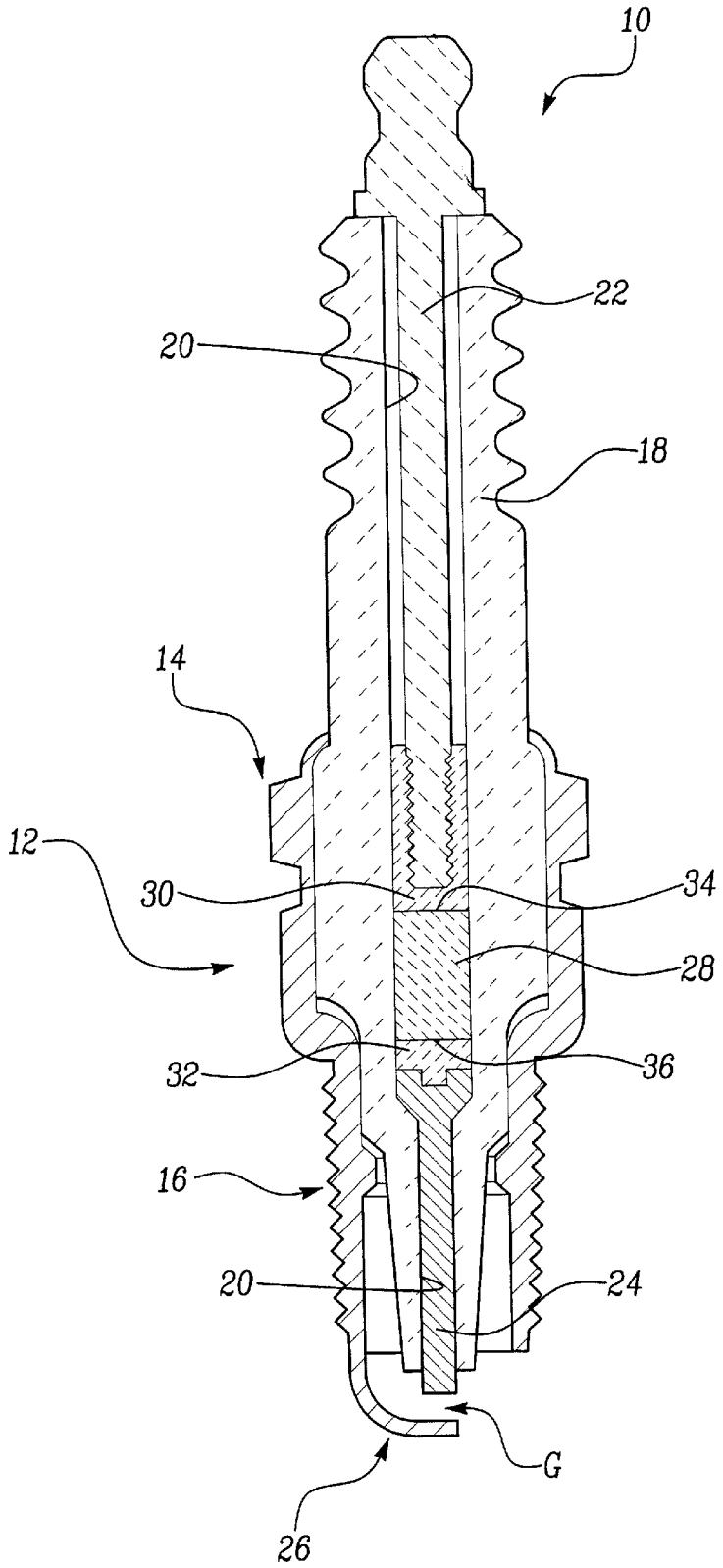
FIGURE
PRIOR ART

CONTACT GLASS COMPOSITION FOR USE IN SPARK PLUGS

BACKGROUND OF THE INVENTION

1. Technical Field

This invention relates generally to spark plugs and more particularly to contact glass compositions for use in resistor-type spark plugs.

2. Discussion

All internal combustion gasoline engines employ spark plugs to generate the spark that ignites the air-fuel mixture in the cylinder. Spark plugs are comprised of three basic components: the shell, the insulator, and the electrodes. A resistor-type spark plug has an additional component: the resistor.

With reference to the FIGURE, there is illustrated a cross-sectional view of a conventional resistor-type spark plug 10. A shell 12 having an upper hexagonal-shaped section 14 and a lower threaded section 16 is typically comprised of a metallic material such as steel. The hexagonal-shaped section 14 is used to apply installation torque, while the threaded section 16 allows the spark plug 10 to be conveniently screwed into the cylinder head.

The shell 12 surrounds an insulator 18 which is typically comprised of a refractory or ceramic material, such as aluminum oxide. Insulators must be able to resist heat, cold, chemical corrosion, vibration, and high voltage changes.

A center bore 20 extends longitudinally through the central axis of the insulator 18. A terminal rod or stud 22 is disposed in the upper portion of the center bore 20. The top portion of the terminal stud 22 serves as an attachment point for the spark plug wire assembly.

A center electrode 24 is disposed in the lower portion of the center bore 20. The center electrode 24, as well as other components of the spark plug 10, carries the high-voltage current from the ignition coil and is insulated from the rest of the spark plug 10 by the insulator 18. A side or ground electrode 26 is attached to the shell 12 and is bent inwardly to produce the proper spark gap G between the two electrodes. Once a sufficient amount of voltage has built up, a spark is initiated in the electrode gap G and results in the ignition of the air-fuel mixture in the cylinder. Because the typical modern spark plug is expected to last from 100,000–150,000 miles or more, the electrodes must be constructed of materials that will be resistant to heat, oxidation, erosion, and corrosion. Typical materials used to make spark plug electrodes include alloys of metals such as iron, chrome, nickel, and platinum.

The spark at the electrodes is delivered in two stages. The voltage at the center electrode 24 will rise rapidly until the voltage is sufficient to ionize the gap G and cause the spark plug to fire. This is known as the first stage and is generally capacitive in nature. The second stage is longer and immediately follows the first stage. The second stage is produced by the remaining residual voltage in the ignition coil and is generally inductive in nature.

The combustion process takes place during the first stage. The second stage causes undesirable electromagnetic interference with radio and television communication equipment and other electronic devices. In order to shorten the second stage, it has become increasingly common for spark plug manufacturers to employ a suppressor or resistor of around 5,000–10,000 ohms. The resistor 28 is typically disposed in the center bore 20 between the terminal rod 22 and the center electrode 24 and is surrounded by the insulator 18.

Additionally, two zones of electrically conductive contact glasses 30 and 32 are typically located on either side of the resistor 28, thus defining an upper interface 34 and a lower interface 36 with the resistor 28. The resistor 28 and the two zones of electrically conductive contact glasses 30 and 32 are generally referred to as the resistor body. On one end of the resistor 28 is the electrically conductive contact glass 32 in contact with the center electrode 24, and on the other end of the resistor 28 is the other electrically conductive contact glass 30 in contact with the terminal stud 22. The resistor 28 is positioned inside the insulator 18 either through a filling, tamping and pressure sealing process, or by a pressure sealing process using preformed resistor cartridges.

The chemical composition of resistors may vary widely. For example, some resistors are comprised primarily of a mixture of carbon-based materials and one or more types of glasses, with the resulting mixture being referred to as a resistor glass. These carbon-based resistors are generally referred to as carbon resistors. A carbon resistor designated ES-533S is employed in certain spark plugs marketed under the registered trademark AUTOLITE® by AlliedSignal, Inc. (Morristown, N.J.). These carbon resistors are comprised primarily of a mixture of thermal carbon, lamp black carbon, zirconia (typically in powder form), mullite (typically in powder form), and borosilicate glass (typically in powder form).

Like the resistor, the chemical composition of contact glasses may also vary widely. For example, a contact glass composition designated ES-534 is employed in certain spark plugs marketed under the registered trademark AUTOLITE® by AlliedSignal, Inc. (Morristown, N.J.) having a composition of about 40–45 weight % nickel (typically in flake form), about 45–50 weight % borosilicate glass (typically in powder form), about 10 weight % mullite (typically in powder form), as well as very small amounts of binder materials (e.g., about 0.5 weight % of VEEGUM® Tee ("VGT")) and other metallic materials (e.g., about 0.3 weight % of copper (typically in flake form)).

In the pressure sealing process, the resistor glass mix and the contact glass mix are compressed at a temperature around 1800° F. After sealing, the nickel flake is compacted into a dense network distributed around the compressed borosilicate glass powder particles, and provides paths for the flow of electric current between the center electrode/terminal stud and the resistor glass. The degrees of compression of the nickel flakes, the number and nature of contact points of the conductive elements at and near the interface, and the chemistry and microstructure of the interface can all significantly affect the durability and stability of the resistor.

In vehicle applications, certain resistor-type spark plugs, especially those employing carbon resistors, were found to become non-functional due to degradation of the resistor bodies. Some were found to have their resistance values increase from a nominal value of 5000 ohms up to 1,000,000 or more ohms. In essence, the resistor, or portions thereof, began to function as an insulator. These resistance increases were the result of substantial melting of the resistor glass. The degradation started with local arcing at the interface between the resistor glass and the contact glass closest to the terminal stud. The local arcing eventually led to a large volume melting of resistor glass next to the interface with the contact glass. Other spark plugs were observed to exhibit irregular voltage discharge across the electrode gap. The degradation also started at the contact glass/resistor glass interface with local arcing. The local arcing subsequently led to a number of open channels, providing paths for internal arcing inside the resistor glass.

It is believed that the composition of the contact glass can have a profound effect on the durability and stability of the resistor. The contact glass composition can alter the physical and chemical properties of the interface between the contact glass and the resistor glass. This is particularly true at the entrance closest to the terminal stud where more material flow has taken place during the pressure sealing process.

Therefore, there exists a need for an electrically conductive contact glass composition that provides durability and stability to spark plug resistors.

SUMMARY OF THE INVENTION

In accordance with one embodiment of the present invention, a contact glass composition for use in resistor-type spark plugs, comprises a mixture of (a) at least one electrically conductive material selected from the group consisting of nickel, copper, iron, zinc, titanium, silver, and oxides thereof; (b) graphite; and (c) silicon.

In accordance with another embodiment of the present invention, a contact glass composition for use in resistor-type spark plugs, comprises a mixture of (a) at least one electrically conductive material selected from the group consisting of nickel, copper, iron, zinc, titanium, silver, and oxides thereof; (b) graphite; (c) silicon; (d) borosilicate glass; (e) barium borate glass; (f) magnesium aluminum silicate; (g) ball clay; and (h) aluminum.

In accordance with yet another embodiment of the present invention, a resistor body for use in a resistor-type spark plug having a terminal stud and a center electrode, comprises (a) a resistor; (b) a first contact glass composition adjacent to the resistor and the terminal stud, the first contact glass composition comprising a mixture of (i) at least one electrically conductive material selected from the group consisting of nickel, copper, iron, zinc, titanium, silver, and oxides thereof; (ii) graphite; and (iii) silicon; and (c) a second contact glass composition adjacent to the resistor and the center electrode, the second contact glass composition comprising a mixture of (i) at least one electrically conductive material selected from the group consisting of nickel, copper, iron, zinc, titanium, silver, and oxides thereof; (ii) graphite; and (iii) silicon.

A more complete appreciation of the present invention and its scope can be obtained from understanding the accompanying drawing, which is briefly summarized below, the following detailed description of the invention, and the appended claims.

BRIEF DESCRIPTION OF THE DRAWING

The FIGURE illustrates a cross-sectional view of a conventional resistor-type spark plug.

DETAILED DESCRIPTION OF THE INVENTION

In order to avoid the problems associated with conventional resistor-type spark plugs, the present invention has altered the chemical and physical composition of the contact glass composition in order to provide stability and durability to the spark plug resistor, especially at the interface between the contact glass and the resistor.

Without being bound to a particular theory of the operation of the present invention, it was believed that by replacing a portion of the nickel flake (i.e., an electrically conductive metal) of the contact glass composition with graphite and/or silicon (both preferably in the form of a powder), both of which are also electrically conductive materials under certain circumstances, the physical and chemical properties of the interface between the contact glass and the resistor would be greatly enhanced. In addition to nickel, various metals (e.g., copper, iron, zinc, titanium, and silver) and metal oxides (e.g., titanium dioxide and copper oxide) may also be employed as electrically conductive materials in the contact glass composition.

With respect to the nickel, graphite and silicon components employed in the various contact glass compositions of the present invention, reference is made to the following: 200 mesh nickel flake was obtained from Novamet Specialty Products (Wyckoff, N.J.); 300 mesh size graphite flake was obtained from Alfa Aesar Division of Johnson Matthey (Ward Hill, Mass.); 325 mesh size industrial grade graphite powder was obtained from SKW Metals and Alloys, Inc. (Niagara Falls, N.Y.) a distributor for Graphitwerk Kropfmuhl AG (Hauzenberg, Germany); 325 mesh size industrial grade graphite powder was obtained from Ashbury Graphite Mills, Inc. (Ashbury, N.J.); 300 mesh size lab grade silicon powder was obtained from Alfa Aesar Division of Johnson Matthey (Ward Hill, Mass.); and 200 mesh size industrial grade silicon powder was obtained from Simcala (Mt. Meigs, Ala.).

Initial experimental results involving contact glass formulations having substituted nickel flake with graphite only (i.e., no silicon), indicated that while the graphite increased the durability of the resistor, it also continuously decreased the resistance values at a slow rate as testing progressed. For example, certain resistor bodies with contact glass having graphite substituted for the nickel flake had a high percentage of resistor bodies showing a continuous decrease in resistance from the nominal 5000 ohms down to the 1500–2000 ohms range after 24 hours of testing.

In order to counterbalance the effect that the graphite was having on resistance, silicon was then added to the contact glass formulation. Like graphite, silicon also increased the durability of the resistor. However, silicon correlates with continuous increases in resistance as the test time increases, thus counteracting the decrease in resistance caused by the graphite.

Without being bound to a particular theory of the operation of the present invention, it was believed that by replacing the borosilicate glass powder, which is the major soft filler of a typical conventional contact glass composition, with borosilicate glass powder of a smaller particle (i.e., mesh) size, material segregation would be reduced. A 60 and a 80 mesh size borosilicate glass powder (i.e., ferro borosilicate glass) was obtained from Ferro Corporation (Cleveland, Ohio).

Microstructural examination of polished cross-sections indicated that by replacing the conventional 40 mesh borosilicate glass powder with a finer mesh size (i.e., smaller particle size) borosilicate glass powder, a significant reduction in material segregation was achieved, thereby avoiding large particles segregated at the interface. In accordance with one embodiment of the present invention, a 60 mesh borosilicate glass powder is employed as a soft filler in the contact glass composition. Preferably, the mesh size of the borosilicate glass powder employed in the contact glass composition is less than 40, more preferably in the range of 40 to 60, and still more preferably less than 60.

Without being bound to a particular theory of the operation of the present invention, it was also believed that by replacing the borosilicate glass powder, which is the major soft filler of a typical conventional resistor glass composition, with borosilicate glass powder of a smaller particle (i.e., mesh) size, material segregation would be reduced. In accordance with one embodiment of the present invention, a 80 mesh borosilicate glass powder is employed as a soft filler in the resistor glass composition.

Without being bound to a particular theory of the operation of the present invention, it was believed that by adding barium borate glass, which is a fusible glass at the pressure sealing temperature, it would provide a matrix to hold the fine electrically conductive powders of the contact glass composition. A 140 mesh size barium borate glass powder (i.e., ferro barium borate glass) was obtained from Ferro Corporation (Cleveland, Ohio).

Initial experimental results indicated that adding barium borate glass helped improve the consolidation of the fine conductive powders in the contact glass composition, and also helped the bonding of the contact glass to the resistor glass. It would be particularly helpful if the contact glass composition of the present invention is used for pre-forming resistor cartridges. However, it should be noted that increasing the amount of the barium borate glass beyond about 7 weight % appears to increase irregularity of the pulse loops.

Without being bound to a particular theory of the operation of the present invention, it was believed that by adding aluminum (preferably in powder form), which consumes oxygen during the pressure sealing process, it would reduce any oxidation of the nickel, graphite and silicon powders of the contact glass composition. A 325 mesh size aluminum powder was obtained from Alfa Aesar Division of Johnson Matthey (Ward Hill, Mass.).

Initial experimental results indicated that adding fine aluminum powder appears to improve resistor performance.

Microstructural observations of the polished cross-sections also revealed that the erratic pulse loop failure is the result of formation of a few arc channels opened up by arc melting. The arc channels propagated from the interface closest to the terminal stud to the other interface. They interrupted only a fraction of the conductive paths, and therefore caused only a moderate increase in resistance, e.g., from 5000 ohms to the 10,000–20,000 ohms range.

Additional ingredients may also be included in the contact glass composition of the present invention. These ingredients include, but are not limited to binders such as clay, preferably in either the 100 mesh dry or 325 slurry form (commercially available from Kentucky-Tennessee Clay Company (Mayfield, Ky.), and VGT, preferably in the 325 mesh form (commercially available from R. T. Vanderbilt Company (Norwalk, Conn.), as well as electrical conductors/reducing agents such as carbon black (e.g., lamp black), preferably in the 325 mesh form (commercially available from Maroon, Inc. (Westlake, Ohio), a distributor of Chemische Werke Brockhues AG (Walluf, Germany)). One advantage of the present invention is that components such as carbon black, previously taught to be deleterious to the performance of the sealing glass (see, e.g., U.S. Pat. No. 5,565,730), can now be included in sealing glass compositions with little adverse impact.

In order to evaluate the various contact glass compositions of the present invention, a carbon resistor glass with a designed resistance value of 5000 ohms was used for testing purposes.

Two different resistor glass compositions were formulated: a standard, and two alternative compositions designated RR-1 and RR-2. The only significant difference among the three resistor glass compositions is that the standard and the RR-1 contained conventional 40 mesh borosilicate glass, whereas the RR-2 contained 80 mesh borosilicate glass. The resistor slurry used in all three formulations was comprised of thermal carbon, carbon black, zirconia, water, and binders. The mix sizes of the standard and two alternative resistor glasses are as follows: standard (400 lbs.) RR-1 (5 lbs.), and RR-2 (5 lbs.). By way of a non-limiting example, the compositions of the standard and the two alternative resistor glasses (expressed in weight percent) are presented in Table I, below:

TABLE I

| MATERIALS | STD | RR-1 | RR-2 |
|---|---|---|---|
| Borosilicate | | | |
| Glass (wt. %) | 23.0 | 23.0 | 23.0 |
| Mesh Size | 40 | 40 | 80 |
| Barium Borate | | | |
| Glass (wt. %) | 21.0 | 21.0 | 21.0 |
| Resistor | | | |
| Slurry (wt. %) | 38.0 | 38.0 | 38.0 |
| Mullite (wt. %) | 15.5 | 15.5 | 15.5 |
| Ball Clay (wt. %) | 2.5 | 2.5 | 2.5 |

Batches of various contact glass compositions were then formulated and designated A, B, C, D, E, F, and G. These contact glass compositions were then sealed by conventional means with the standard 5000 ohms resistor glass to form a resistor body. The standard resistor glass formulation disclosed in Table I was used in conjunction with these contact glass compositions. The resistor bodies were prepared on production lines using several types of insulator bodies, and sealed at temperatures varying from 1700° to 1900° F.

In order to determine the effectiveness of the various contact glass compositions, the resistor bodies were then tested on a customized 5 KV high energy durability tester in reverse polarity. Properties of the resistor bodies were measured at the time intervals of 0, 24, 72–96 and 136–144 test hours. Initial low voltage resistance, high voltage resistance and final low voltage resistance values were measured with a digital meter (Model 178 multimeter, Keithley Instruments, Inc., Cleveland, Ohio) and a customized 5 KV pulse tester. The shape of the pulse loops were observed and recorded using an oscilloscope (Model R5103, Tektronix, Inc., Redmond, Oreg.).

In measuring the high voltage resistance (HVR), any resistance value greater than 50,000 ohms was considered a failure. At each measuring interval, the average HVR was computed. The percentage of resistor samples that failed and the average HVR of the remaining resistor bodies were also computed. In evaluating the pulse loop shapes, a resistor body exhibiting an unstable pulse loop which prevented determination of a HVR value was also considered a failure. The percentage of samples that exhibited an unstable pulse loop were also recorded. The mix sizes of the standard and various contact glass compositions are as follows: standard (400 lbs.), A (5 lbs.), B (5 lbs.), C (5 lbs.), D (5 lbs.), E (5 lbs.), F (5 lbs.), and G (125 lbs.). By way of a non-limiting example, the compositions of the standard and various contact glasses (expressed in weight percent) are presented in Table II, below:

TABLE II

| MATERIALS | STD | A | B | C | D | E | F | G |
|---|---|---|---|---|---|---|---|---|
| Borosilicate | | | | | | | | |
| Glass (wt. %) | 45.0 | 40.0 | 48.0 | 48.0 | 48.0 | 51.0 | 48.0 | 48.0 |
| Mesh Size | 40 | 40 | 60 | 60 | 60 | 60 | 60 | 60 |
| Nickel (wt. %) | 44.2 | 20.0 | 29.0 | 29.0 | 29.0 | 28.5 | 29.0 | 29.0 |
| Graphite (wt. %) | 0.0 | 14.0 | 11.0 | 11.0 | 11.0 | 7.5 | 10.0 | 11.0 |
| Mesh Size | 325 | 325 | 325 | 325 | 325 | 325 | 325 | |
| Silicon (wt. %) | 0.0 | 12.0 | 3.0 | 3.0 | 3.0 | 3.0 | 3.0 | 3.0 |
| Mesh Size | 300 | 300 | 200 | 200 | 200 | 200 | 200 | |
| Barium Borate Glass (wt. %) | 0.0 | 10.0 | 5.0 | 5.0 | 5.0 | 5.5 | 5.0 | 5.0 |
| Aluminum (wt. %) | 0.0 | 1.0 | 1.0 | 1.0 | 1.0 | 1.0 | 1.0 | 1.0 |
| Clay (wt. %) | 0.0 | 2.0 | 2.0 | 2.0 | 2.0 | 2.5 | 2.0 | 2.0 |
| VGT (wt. %) | 0.5 | 1.0 | 1.0 | 1.0 | 1.0 | 1.0 | 1.0 | 1.0 |
| Mullite (wt. %) | 10.0 | 0.0 | 0.0 | 0.0 | 0.0 | 0.0 | 0.0 | 0.0 |
| Lamp Black (wt. %) | 0.0 | 0.0 | 0.0 | 0.0 | 0.0 | 0.0 | 1.0 | 0.0 |
| Copper (wt. %) | 0.3 | 0.0 | 0.0 | 0.0 | 0.0 | 0.0 | 0.0 | 0.0 |

It should be particularly noted that nickel can be employed in amounts greater than 29 wt. % in the contact glass compositions of the present invention.

The resistance performance data of the resistor bodies employing the contact glass compositions of Table II, relative to a standard contact glass composition, is presented in Table III, below:

TABLE III

| | STD | A | B | C | D | E | F | G |
|---|---|---|---|---|---|---|---|---|
| 0 Hour HVR (K ohms) | 5.2 | 5.2 | 5.8 | 5.2 | 5.4 | 5.0 | 6.2 | 4.7 |
| 0 Hour Unstable P-Loop % | 0 | 0 | 0 | 0 | 0 | 0 | 0 | 0 |
| 24 Hour HVR (K ohms) | 5.1 | 4.4 | 5.1 | 5.8 | 5.9 | 5.6 | 5.2 | 6.6 |
| 24 Hour Unstable P-Loop % | 0 | 0 | 0 | 17 | 8 | 2.1 | 0 | 0 |
| 72–96 Hour HVR (K ohms) | 10.6[1] | 5.5 | 5.4 | 5.0 | 7.0 | 8.3[3] | 4.1 | 8.6 |
| 72–96 Hour Unstable P-Loop % | 0 | 0 | 2 | 4 | 8 | 6.5 | 4.2 | 5 |
| 136-144 Hour HVR (K ohms) | 12.3[2] | 7.5 | 6.1 | 5.6 | 7.5 | 7.3[4] | 6.2 | 9.1 |
| 136–144 Hour Unstable P-Loop % | 5 | 0 | 0 | 8 | 3 | 2.1 | 2.1 | 5 |

[1]= 24% failure rate; the 10.6 K ohms HVR value refers to the remaining samples.
[2]= 42% failure rate; the 12.3 K ohms HVR value refers to the remaining samples.
[3]= 4% failure rate; the 8.3 K ohms HVR value refers to the remaining samples.
[4]= 10.4% failure rate; the 7.3 K ohms HVR value refers to the remaining samples.

It is important to note that by choosing a proper ratio of the nickel, graphite and silicon powders used in the contact glass composition, one can produce a resistor body with a significant improvement over the current production resistor in terms of durability and stability. It appears that with a sufficient amount of nickel, the effects of graphite and silicon powders are counterbalanced to produce a stable resistor body.

In order to determine the effectiveness of the RR-1 and RR-2 resistor glass compositions, several resistor bodies incorporating these alternative resistor glass compositions were assembled and then tested on a 5 KV high energy durability tester in reverse polarity. Properties of the resistor bodies were measured at the time intervals of 0, 24, 72–96 and 136–144 test hours. Initial low voltage resistance, high voltage resistance and final low voltage resistance values were measured with a digital meter and a 5 KV pulse tester. The shape of the pulse loops were observed and recorded using an oscilloscope.

In measuring the high voltage resistance (HVR), any resistance value greater than 50,000 ohms was considered a failure. At each measuring interval, the average HVR was computed. The percentage of resistor samples that failed and the average HVR of the remaining resistor bodies were also computed. In evaluating the pulse loop shapes, a resistor body exhibiting an unstable pulse loop which prevented determination of a HVR value was also considered a failure. The percentage of samples that exhibited an unstable pulse loop were also recorded. The following resistor glass/contact glass combinations were tested: RR-1/C; RR-2/C; RR-2/D; and RR-2/G. The compositions of RR-1 and RR-2 were previously disclosed in Table I. The compositions of C, D, and G were previously disclosed in Table II. The resistance performance of the resistor bodies employing the aforementioned resistor glass/contact glass combinations is presented in Table IV, below:

TABLE IV

| | RR-1/C | RR-2/C | RR-2/D | RR-2/G |
|---|---|---|---|---|
| 0 Hour HVR (K ohms) | 2.3 | 3.4 | 3.9 | 3.9 |
| 0 Hour Unstable P-Loop % | 0 | 0 | 0 | 0 |
| 24 Hour HVR (K ohms) | 2.6 | 4.0 | 3.9 | 4.1 |
| 24 Hour Unstable P-Loop % | 5 | 0 | 0 | 0 |
| 72–96 Hour HVR (K ohms) | 2.5[5] | 4.2 | 4.3 | 4.1 |
| 72–96 Hour Unstable P-Loop % | 0 | 0 | 0 | 0 |
| 136–144 Hour HVR (K ohms) | 3.4[6] | 4.9 | 4.5 | 4.2 |
| 136–144 Hour Unstable P-Loop % | 0 | 0 | 0 | 0 |

5 = 5% failure rate; the 2.5 K ohms HVR value refers to the remaining samples.
6 = 5% failure rate; the 3.4 K ohms HVR value refers to the remaining samples.

5=5% failure rate; the 2.5 K ohms HVR value refers to the remaining samples. 6=5% failure rate; the 3.4 K ohms HVR value refers to the remaining samples.

The resistance performance data in Table IV illustrates the benefits of employing a resistor glass composition containing borosilicate glass powder having a mesh size less than 40. Preferably, the mesh size of the borosilicate glass powder employed in the resistor glass composition is less than 40, more preferably in the range of 40 to 80, and still more preferably less than 80.

The foregoing description is considered illustrative only of the principles of the invention. Furthermore, because numerous modifications and changes will readily occur to those skilled in the art, it is not desired to limit the invention to the exact construction and process shown as described above. Accordingly, all suitable modifications and equivalents that may be resorted to that fall within the scope of the invention as defined by the claims that follow.

What is claimed is:

1. A contact glass composition for use in resistor-type spark plugs, comprising a mixture of:

(a) about 20 weight percent to about 29 weight percent of one or more metals or metal oxides selected from the group consisting of nickel, copper, iron, zinc, titanium, silver, and oxides thereof;

(b) about 7.5 weight percent to about 14 weight percent of graphite; and (c) about 3 weight percent to about 12 weight percent of silicon.

2. The contact glass composition of claim 1 that is a borosilicate glass-based composition.

3. The contact glass composition of claim 2, wherein the borosilicate glass has a particle size less than about 40 mesh.

4. A contact glass composition according to claim 1, further comprising at least one component selected from the group consisting of barium borate glass, magnesium aluminum silicate, ball clay, aluminum, and carbon black.

5. A contact glass composition according to claim 1, further comprising carbon black.

6. A contact glass composition for use in resistor-type spark plugs, comprising a mixture of:

(a) nickel;

(b) graphite;

(c) silicon;

(d) borosilicate glass;

(e) barium borate glass;

(f) magnesium aluminum silicate;

(g) ball clay; and (h) aluminum.

7. A resistor body for use in a resistor-type spark plug having a terminal stud and a center electrode, comprising:

(a) a resistor;

(b) at least one contact glass composition between the resistor and the center electrode comprising a mixture of:

(i) about 20 weight percent to about 29 weight percent, based on the weight of the contact glass composition, of one or more electrically conductive metals or metal oxides selected from the group consisting of nickel, copper, iron, zinc, titanium, silver, and oxides thereof;

(ii) about 7.5 weight percent to about 14 weight percent, based on the weight of the contact glass composition, of graphite; and (iii) about 3 weight percent to about 12 weight percent, based on the weight of the contact glass composition, of silicon.

8. The resistor body of claim 7, wherein said at least one contact glass composition is a borosilicate glass-based composition.

9. The resistor body of claim 8, wherein the borosilicate glass has a particle size less than about 40 mesh.

10. The resistor body of claim 7, wherein said at least one contact glass composition comprising silicon and graphite further comprises at least one component selected from the group consisting of borosilicate glass, barium borate glass, magnesium aluminum silicate, ball clay, aluminum, and carbon black.

11. The resistor body of claim 7, wherein said at least one contact glass composition comprising silicon and graphite further comprises carbon black.

12. The resistor body of claim 7, including:

(b1) a first contact glass composition adjacent to the resistor and the terminal stud, comprising a mixture of:

(i) about 20 weight percent to about 29 weight percent, based on the weight of the first contact glass composition, of one or more electrically conductive metals or metal oxides selected from the group consisting of nickel, copper, iron, zinc, titanium, silver, and oxides thereof;

(ii) about 7.5 weight percent to about 14 weight percent, based on the weight of the first contact glass composition, of graphite; and (iii) about 3 weight percent to about 12 weight percent, based on the weight of the first contact glass composition, of silicon; and (b2) a second contact glass composition adjacent to the resistor and the center electrode, comprising a mixture of:

(i) about 20 weight percent to about 29 weight percent, based on the weight of the second contact glass composition, of one or more electrically conductive metals or metal oxides selected from the group consisting of nickel, copper, iron, zinc, titanium, silver, and oxides thereof;

(ii) about 7.5 weight percent to about 14 weight percent, based on the weight of the second contact glass composition, of graphite; and (iii) about 3 weight percent to about 12 weight percent, based on the weight of the second contact glass composition, of silicon.

* * * * *